US005548871A

United States Patent [19]

Trethewey

[11] Patent Number: 5,548,871

[45] Date of Patent: Aug. 27, 1996

[54] BUNDLING STRAP

[76] Inventor: Brig E. A. Trethewey, S14 CBI RR6, Vernon, British Columbia, Canada, V1T 6Y5

[21] Appl. No.: 350,687

[22] Filed: Dec. 7, 1994

[51] Int. Cl.[6] ..... A44B 18/00; B65D 63/00

[52] U.S. Cl. ..... 24/16 R; 24/306; 24/442

[58] Field of Search ..... 24/16 R, 17 AP, 24/306, 442, 16 PB, 30.5, 31 V, 3.13, 197, 200; 2/912, 920; 128/DIG. 15

[56] References Cited

U.S. PATENT DOCUMENTS

| | | | |
|---|---|---|---|
| 3,414,943 | 12/1968 | Hattori | 24/16 R |
| 3,731,348 | 5/1973 | Luehne | 24/16 PB |
| 3,827,107 | 8/1974 | Moore | 24/16 R |
| 3,947,927 | 4/1976 | Rosenthal | 24/16 R |
| 4,005,506 | 2/1977 | Moore | 24/16 R |
| 4,088,136 | 5/1978 | Hasslinger et al. | 128/349 R |
| 4,096,863 | 6/1978 | Kaplan et al. | 128/349 R |
| 4,114,838 | 9/1978 | Knauf | 224/45 S |
| 4,138,770 | 2/1979 | Barrette et al. | 24/16 PB |
| 4,149,540 | 4/1979 | Hasslinger | 128/327 |
| 4,569,348 | 2/1986 | Hasslinger | 604/179 |
| 4,571,245 | 2/1986 | Hubbard et al. | 604/179 |
| 4,700,432 | 10/1987 | Fennel | 24/16 R |
| 4,862,563 | 9/1989 | Flynn | 24/306 |
| 4,893,381 | 1/1990 | Frankel | 24/16 R |
| 5,076,288 | 12/1991 | Millard et al. | 128/DIG. 15 |
| 5,086,543 | 2/1992 | Mitchell | 24/16 R |
| 5,167,050 | 12/1992 | Korsen | 24/16 R |
| 5,237,988 | 8/1993 | McNeese | 24/306 |

OTHER PUBLICATIONS

Brochure entitled *RIP–TIE—Velcro Cable Wraps,* The Rip–Tie Company, San Francisco, CA: 1993, 2 pages, depicting a sketch and price lists.

Literature entitled "Directions to Use the 4–Bar Buckle with Velcro Brand Omni–Tape Straps", dated 1993, (1 page).

Literature entitled "Velcro Brand Standard Reusable Fastening Straps", dated Oct. 1992 (one page).

Literature entitled "Product Information Guide", undated, (one page).

Literature entitled "Introducing the Best Way to Hold Down Both Cables & Costs", undated, (one page).

Literature entitled "Velcro Brand Cable Straps", undated, (one page).

Brochure entitled *3M Refastenable Tape Closure System,* St. Paul, MN: 1993, 2 pages.

Brochure entitled *RIP–TIE—Velcro Cable Wraps,* The Rip–Tie Company, San Francisco, CA: 1993, 2 pages, illustrating articles for wrapping cables.

*Primary Examiner*—Victor N. Sakran

*Attorney, Agent, or Firm*—Cahill, Sutton & Thomas P.L.C.

[57] ABSTRACT

Opposed ends of a bundling strap are inserted through an anchor and folded back upon respective segments of the strap. Pressure sensitive adhering elements having high shear strength and low tensile strength retain the strap ends adjacent the respective segments of the strap.

11 Claims, 3 Drawing Sheets

FIG. 7
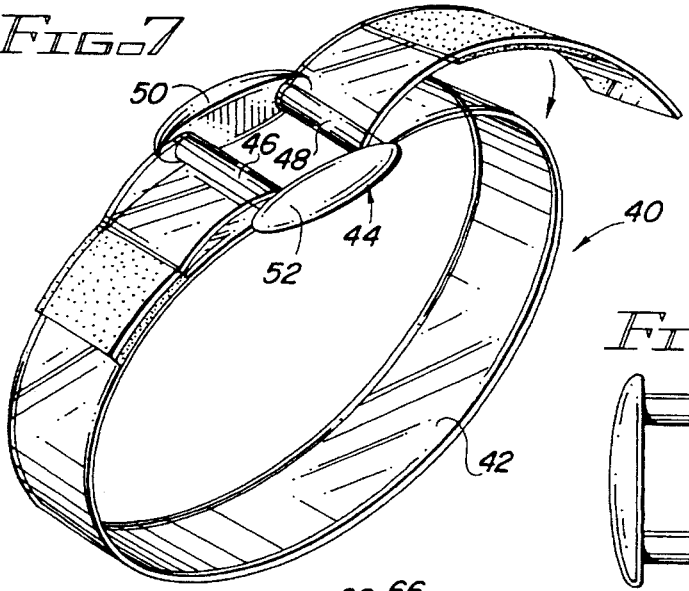
FIG. 9
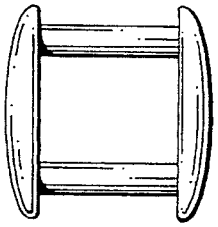
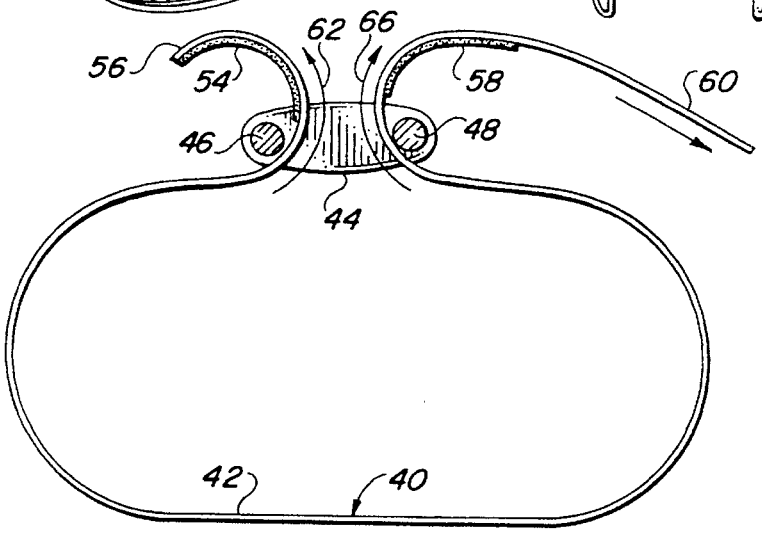
FIG. 10
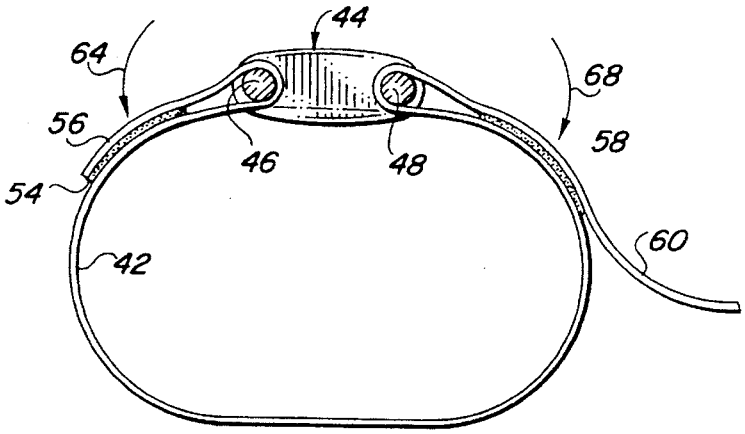
FIG. 11
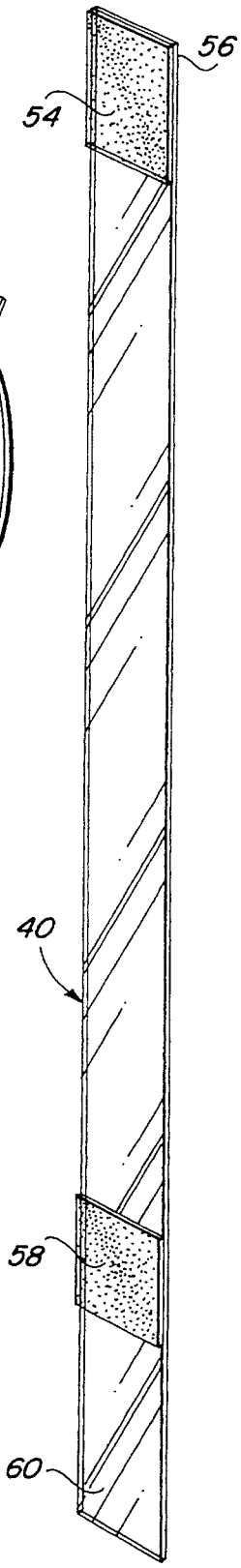
FIG. 8

BUNDLING STRAP

BACKGROUND OF THE INVENTION

1. Field of the Invention

The present invention relates to straps and, more particularly, to infinitely adjustable bundling straps.

2. Description of Related Art

Straps for securing bundles of elements have been used since time immemorial. Early straps included thongs wrapped about bundles. With the advent of rope or twine, such were used as substitutes due to more ready availability and reduced cost. When straps with buckles became prevalent, they were used due to the ease with which the strap could be tightened and retained tight about a bundle of elements. Numerous versions of buckles have been used with greater or lesser success. To obtain infinite adjustment of a strap, a pair of rings are attached to one end of the strap and the free end is threaded through and about the rings to permit tightening by pulling upon the free end. A strap having a single ring secured to one end could be infinitely adjustable by inserting the free end through the ring and folding it back upon itself to secure it with a hook and loop fastener device. Because all of these types of straps required a fixed end and a limited length adjustable end, each strap could only be usable within a certain range of length of the adjustable end. To overcome such limitations, buckles with cams and the like to seize the free end of the strap provide a greater range of sizing. However, cammed buckles are relatively more expensive than the simple inexpensive limited range straps.

SUMMARY OF THE INVENTION

Opposed ends of a strap are inserted through an element, such as a common D-ring, and folded back upon one another to secure a bundle of elements therewithin. Each folded back end engages the corresponding underlying strap section with a high shear load fastening device to prevent disengagement. As each free end is infinitely adjustable with respect to its underlying strap section, either or both free ends may be drawn through the D-ring to tighten the strap about the bundle of elements to be secured. The fastening means attendant each free end and underlying strap may be of the hook and loop type. Preferably, a tab having one of hook or loop elements on its opposed sides is interleaved between the free end and the underlying strap to engage the other of the hook or loop elements. The hook and loop elements may be substituted with reusable adhesive strips. To increase the friction between each free end and its respective underlying strap, the ring may include a pair of rods associated with each strap free end; the free end is folded about one of the rods, beneath the second rod and adjacent the strap to urge the free end against the strap upon drawing the free end tight. Fastening means secure the free end to the underlying strap.

It is therefore a primary object of the present invention to provide a bundling strap having opposed adjustably attached free ends.

Another object of the present invention is to provide fastening devices for securing at least one folded back opposed end of a strap to secure the strap about a bundle of elements.

Yet another object of the present invention is to provide an infinitely adjustable fastening device for securing each of opposed ends of a bundling strap.

Still another object of the present invention is to provide fastening devices for opposed ends of a bundling strap, which fastening devices are particularly resistent to shear loads.

A further object of the present invention is to provide a bundling strap having folded back opposed ends engaged with opposed sides of a ring.

A yet further object of the present invention is to provide an inexpensive infinitely adjustable bundling strap.

A yet further object of the present invention is to provide a ring having multiple cross members for entwining engagement by opposed ends of a bundling strap and fastening means for securing the free ends to the respective adjacent segments of the strap.

A still further object of the present invention is to provide a method for securing a bundle of elements.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 7 illustrates a variant of the bundling strap;

FIG. 8 illustrates the components of the variant strap;

FIG. 9 illustrates a ring for engagement by the strap shown in either of FIGS. 1 or 7;

FIG. 10 illustrates mounting of the variant strap;

FIG. 11 illustrates the variant strap in locked engagement;

DESCRIPTION OF THE PREFERRED EMBODIMENT

Figure 1:
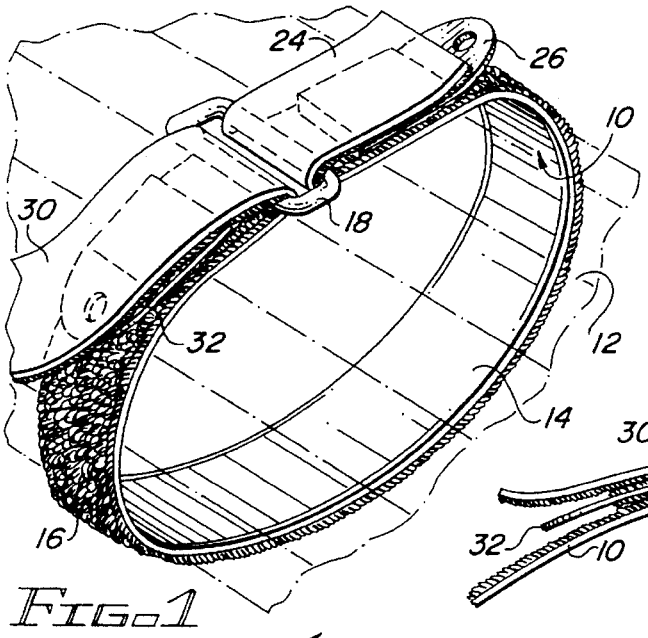
FIG. 1 illustrates a bundling strap disposed about a bundle of elements.
Figure 5:
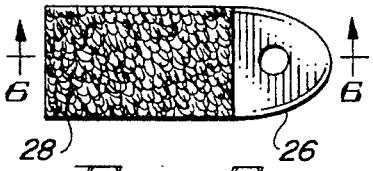
FIG. 5 illustrates an insert for locking a folded back end.
Figure 2:
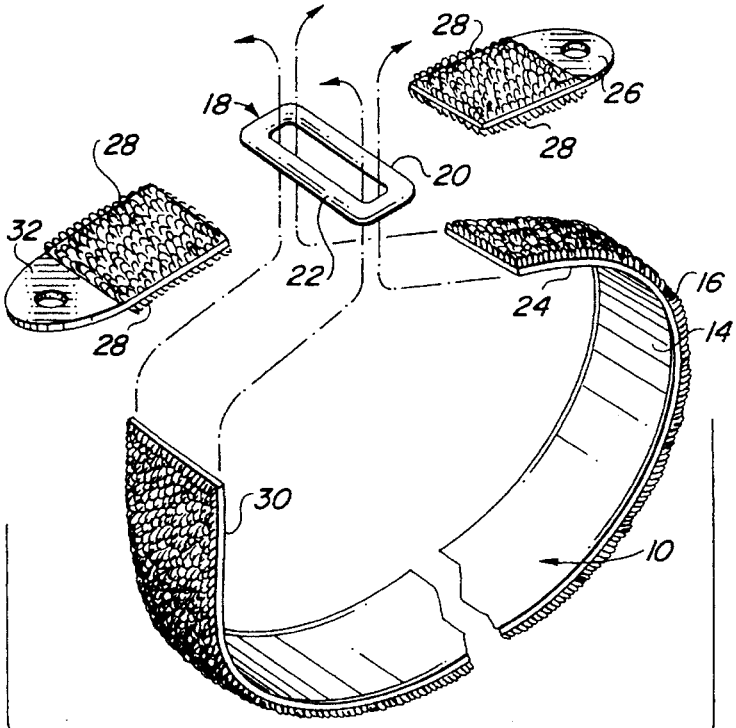
FIG. 2 illustrates the components of the bundling strap.
Figure 6:
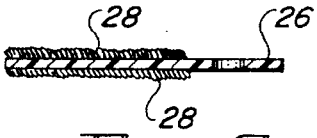
FIG. 6 is a cross sectional view taken along lines 6—6, as shown in FIG. 5.

Referring to FIG. 1, there is illustrated a bundling strap 10 disposed about a bundle of elements 12 (depicted in phantom lines). As also shown in FIG. 2, the strap includes a substrate 14 of a selected length commensurate with the girth of the bundle of elements 12 to be wrapped. The exterior surface of substrate 14 includes a bed of loops 16 of a hook and loop type fastening apparatus. A rectangular ring 18, sometimes referred to as a D-ring, includes a pair of opposed straight rods 20, 22. Alternatively, a U shaped element having two arms joined at one end could be used in place of ring 18. As the ring or U shaped element serve in a manner of an anchor to secure the ends of the strap, they may be referred to as an anchor.

Figure 4:
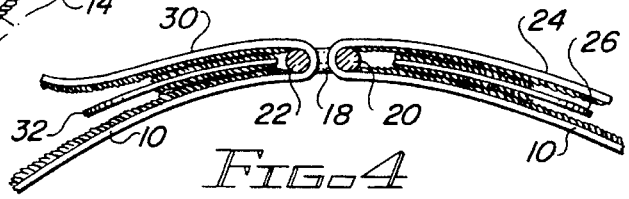
FIG. 4 is a cross sectional view illustrating the folded back opposed ends in locking engagement.
Figure 3:
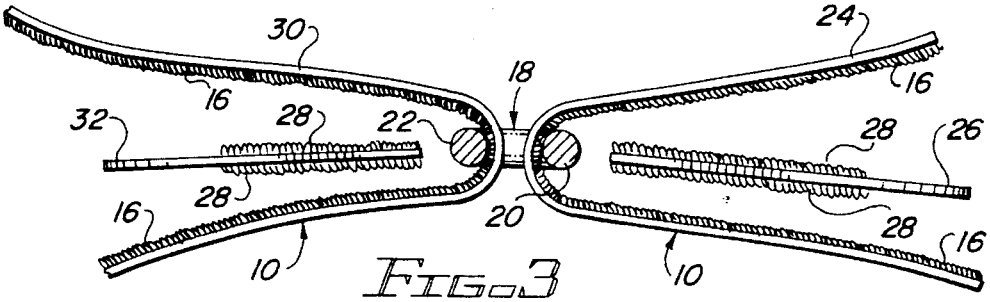
FIG. 3 is a cross sectional view illustrating the folded back opposed ends prior to locking engagement.

Referring jointly to FIGS. 2, 3 and 4 in particular, further structure and function of bundling strap 10 will be described. End 24 of the strap is passed through ring 18 and folded about rod 20 and back upon itself, as depicted in FIGS. 3 and 4. A tab 26 has a bed of hooks of the hook and loop type fastening apparatus disposed on opposed sides. The tab is placed between end 24 and the main body of strap 10. Upon folding end 24 upon the strap with tab 26 disposed therebetween, hooks 28 of the tab will lockingly engage loops 16 of both the end and the strap, as depicted in FIG. 4. Such hook and loop fastening device has substantial resistance to shear loads but low peel strength. Accordingly, end 24 can be readily lifted off tab 26 and tab 26 can be readily lifted off the strap. However, loads applied longitudinally to the strap are effectively resisted by the hook and loop type attachment apparatus.

After strap 10 has been wrapped around a bundle of elements 12, end 30 is passed through ring 18 and partly about rod 22. Upon pulling of end 30, strap 10 will tighten about the bundle of elements 12. When a sufficient degree of tautness is achieved, tab 32, which is identical with tab 26, is placed against loops 16 of strap 10 to achieve mating engagement therewith. End 30, after having been folded back upon strap 10, is pressed against tab 32 to mate its loops 16 with hooks 28 of the tab, as illustrated in FIG. 4. Tab 32 may include an uncovered section, as illustrated, to assist in gripping the tab. The resulting resistance to shear loads created by tab 32 in mating engagement with both strap 10 and end 30 will prevent loosening of the strap about encircled bundle of elements 12. It is to be understood that the locations of the bed of hooks 28 and the bed of loops 16 could be interchanged without any resulting change or modification in function or operation of bundling strap 10.

Referring to FIG. 7, there is illustrated a variant strap 40 of bundling strap 10. The variant strap includes a strap 42 of bendable plastic, which may be transparent as shown, and a ring 44 for engaging opposed ends of the strap. Preferably, the bendable plastic is soft vinyl. The ring may be of the type illustrated in FIG. 2 but preferably it is of the type illustrated in FIGS. 7 and 9 to help retain the straps in position upon the ring. Ring 44 includes a pair of spaced apart rods 46, 48 joined to one another by opposed side members 50, 52. These side members have a width greater than rods 46, 48 to permit the interior sides of the side members to act as shoulders for the corresponding edges of the strap ends.

As shown in FIG. 8, strap 40 may be transparent, as depicted, or opaque. It includes a length of double sided adhesive tape 54 disposed proximate end 56 of the strap. This tape may be full width as shown or of a lesser width. A further section of double sided adhesive tape 58 is disposed proximate end 60 of the strap but preferably not at the end, as illustrated.

The operation of variant strap 40 will be described with primary reference to FIG. 10 and 11. End 56 of strap 42 is passed through ring 44, as depicted by arrow 62, partially about rod 46 and folded back upon itself, as depicted by arrow 64. With such folding, tape 54 will adhere to the underlying surface of strap 42. The remainder of strap 42 is wrapped about the bundle of elements to be secured and end 60 is passed through ring 44. End 60 is drawn partially about rod 48, as depicted by arrow 66, to tighten strap 42 about the bundle of elements. When a sufficient degree of tautness is achieved, end 60 is folded back upon the strap, as depicted by arrow 68, to bring tape 58 into adhering contact with the underlying strap. The shear strength of tape 54 intermediate strap 42 and end 56 and the shear strength of tape 58 intermediate strap 42 and end 60 is substantial. Such shear strength will greatly resist loosening of the strap about the bundle of elements encircled. However, the peel strength of tape 54 and 58 is relatively modest. Thus, the ends of the strap can be relatively easily disengaged from the underlying strap by pulling upon the ends away from the strap. Furthermore, the strap can be retightened or loosened with relative ease and without affecting to a significant degree the shear strength or holding power, of the tape attached junctions. To preserve the adhering quality and power of the surfaces of tapes 54 and 58, a peel-off element may be placed upon the tapes prior to use to protect them. Tape suitable for this purpose is available from the 3M company, St. Paul, Minn., and sold under catalog numbers 9220, 9221 and possibly others.

Pressure sensitive adhering elements, other than hook and loop apparatus or adhesive tape, and having high shear strength and low peel strength may be used to detachably attach the ends of the strap to the respective segments of the strap.

Figure 12:
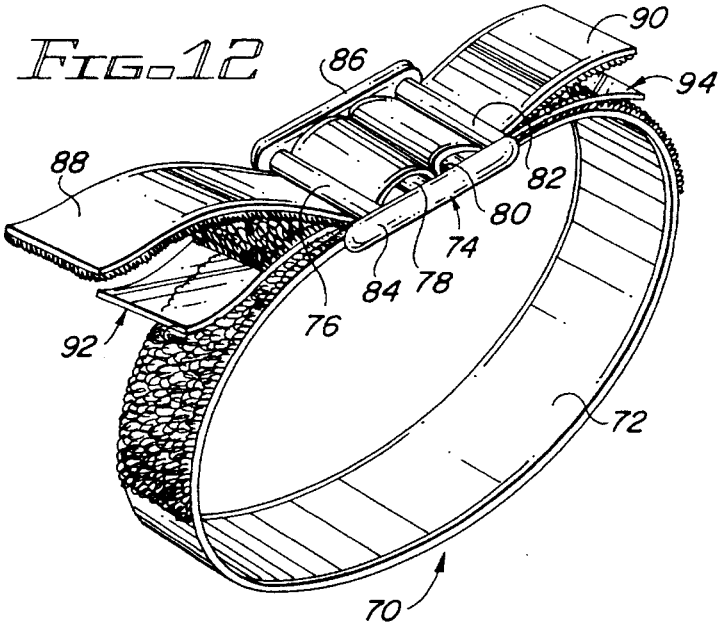
FIG. 12 illustrates a further variant of the bundling strap.
Figure 13:
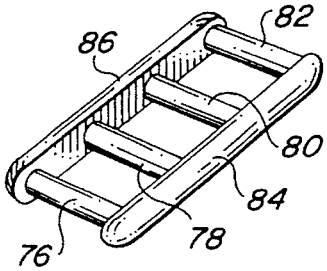
FIG. 13 illustrates a modified D-ring for use with the further variant.
Figure 18:
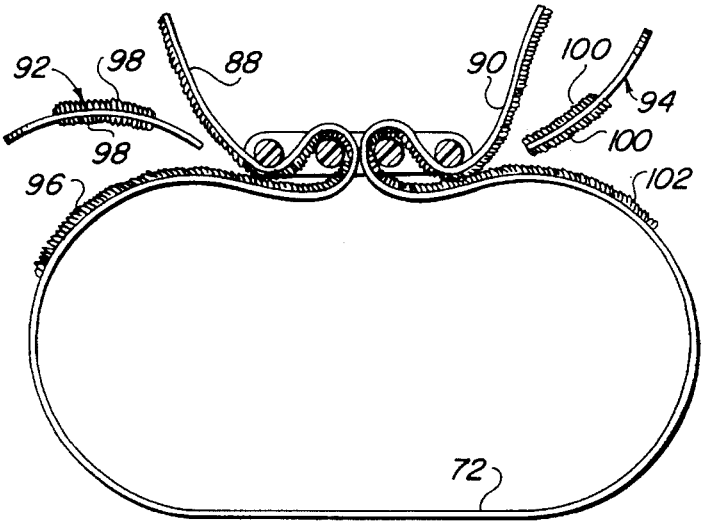
FIG. 18 illustrates the relative relationship of the component parts of the further variant of the bundling strap.

A further variant 70 is illustrated FIG. 12. This variant includes a strap 72 and a ring 74 having two pairs of rods 76, 78 and 80, 82 disposed between side members 84, 86. Strap end 88 is passed between rods 78, 80, folded back about rod 78 and beneath rod 76 adjacent underlying strap 72. Summarily, strap end 90 is passed between rods 78, 80, folded back about rod 80 and beneath rod 82 adjacent strap 72. This entwining of the strap ends is particularly illustrated in FIG. 18.

To retain strap ends 88 and 90 adjacent the corresponding sections of strap 72, fastening means are employed. Such fastening means may include a tab 92 disposed between strap end 88 and strap 72 and a tab 94 disposed between strap end 90 and strap 72. The fastening means may comprise a bed of hooks 96 of hook and loop fastening means disposed upon strap end 88. A bed of loops 98 is disposed on each of opposed sides of tab 92. Upon placement of tab 92 intermediate strap end 88 and strap 72, the beds of hooks and beds of loops will engage one another and result in positionally securing strap end 88 with respect to strap 72. Similarly, tab 94 includes a bed of loops 100 on opposed sides for cooperation with a bed of hooks 102 disposed on one side of strap end 90. The interconnection and interreaction between tabs 92, 94 and the respective strap ends is highly resistent to shear loads. Accordingly, loosening of strap 72 about a bundle of elements (not shown) due to sliding movement of strap ends 88, 90 relative to the underlying sections of strap 72 is greatly resisted. However, the peel strength is relatively slight and permits disengagement of strap ends 88, 90 from the associated tabs and disengagement of the tabs with the straps upon pulling these elements laterally apart from one another. Thereby, the tautness of strap 72 about a bundle of elements can be easily and readily adjusted and modified.

Figure 14:
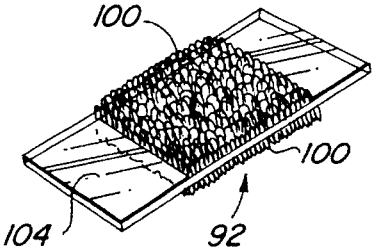
FIG. 14 illustrates a first embodiment of fastening means for securing a free end of a bundling strap with an underlying section of the strap.
Figure 16:
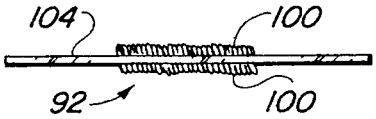
FIG. 16 illustrates a side view of the fastening means embodiment shown in FIG. 14.

FIGS. 14 and 16 illustrate tab 92. This tab includes a substrate 104 supporting bed of loops 100 on opposed sides. The substrate extends from opposed sides of the beds of loops to permit easy gripping. Moreover, the tab may be oriented in either of two directions upon placement intermediate the strap end while maintaining a segment of the substrate available for ease of gripping to insert or remove the tab.

Figure 15:
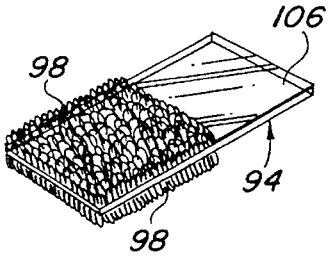
FIG. 15 illustrates a second embodiment of fastening means for securing a free end of a bundling strap with an underlying section of the strap.
Figure 17:
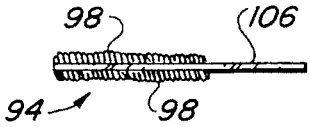
FIG. 17 illustrates a side view of the second embodiment of the fastening means shown in FIG. 15.

Tab 94 illustrated in FIGS. 15 and 17 includes a substrate 106 having beds of loops 98 disposed on opposite sides at one end thereof. The non-covered exposed segment of substrate 106 may be used to grip the tab to put it in place or to remove it.

Substrates 104 and 106 may include uncovered sections, as illustrated, to assist a user in handling tabs 92 and 94.

It is to be understood that the beds of hooks and beds of loops may be reversed without affecting operation of variant bundling strap 70. Moreover, the fastening means for variant 70 defined by the beds of hooks and beds of loops may be replaced with double sided tape adheringly engaging a strap of plastic or similar material, as described with respect to variant 40 illustrated in FIGS. 7–11.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A bundling strap, said bundling strap comprising in combination:

a) an anchor;

b) a strap for extending about one or more elements, said strap including a first end engageable with said anchor and folded back upon said strap and a second end engageable with said anchor and folded back upon said strap;

c) a first tab separate from said strap and positionable intermediate said first end and said strap to secure said first end with said strap and a second tab separate from said strap and positionable intermediate said second end and said strap to secure said end with said strap; and d) a first hook and loop fastening apparatus for retaining said first tab adjacent said strap and said first end folded back upon said first tab and a second hook and loop fastening apparatus for retaining said second tab adjacent said strap and said second end folded back upon said second tab.

2. The bundling strap as set forth in claim 1 wherein each of the opposed sides of each of said first and second tabs includes one of the hooks and loops of said first and second hook and loop fastening apparatus, respectively, and each of said first and second ends and said strap includes an other of the hooks and loops of said first and second hook and loop fastening apparatus, respectively.

3. The bundling straps as set forth in claim 2 wherein each of said first and second tabs includes a substrate having a section for manual gripping and being devoid of said hook and loop fastening apparatus.

4. The bundling strap as set forth in claim 2 wherein one of the hooks and loops of one of said first and second hook and loop fastening apparatus is disposed along said strap.

5. The bundling strap as set forth in claim 1 wherein said anchor includes a first pair of rods for engagement by said first end and a second pair of rods for engagement by said second end.

6. The bundling strap as set forth in claim 5 wherein said first end is folded over one rod of said first pair of rods and passed intermediate the other rod of said first pair of rods and said strap and wherein said second end is folded over one rod of said second pair of rods and passed intermediate the other rod of said second pair of rods and said strap.

7. A bundling strap for securing at least one element, said bundling strap comprising in combination:

a) a strap having first and second ends, each of said first and second ends being foldable back upon said strap;

b) a first tab separate from said strap and positionable intermediate said first end folded back upon said strap and said strap to secure said first end with said strap, a second tab separate from said strap and positionable intermediate said second end folded back upon said strap and said strap to secure said second end with said strap; and c) first hook and loop apparatus for securing said first end with said first tab and for securing said first tab adjacent said strap and second hook and loop apparatus for securing said second end with said second tab and for securing said second tab adjacent said strap.

8. The bundling straps as set forth in claim 7 wherein each of said first and second tabs includes a substrate having a section for manual gripping and being devoid of the respective one of said first and second hook and loop apparatus.

9. A method for securing at least one element, said method comprising the steps of:

a) wrapping a strap about the at least one element;

b) inserting one end of the strap through an anchor and folding the one end back upon the strap;

c) detachably attaching a separate tab intermediate the at least one end and the strap;

d) further inserting another end of the strap through the anchor and folding the other end back upon the strap;

e) drawing the other end to tighten the strap about the at least one element; and f) further detachably attaching another separate tab intermediate the other end and the strap after completion of said step of drawing.

10. The method as set forth in claim 1 wherein each of said steps of detachably attaching and further detachably attaching comprises the step of adhering with a hook and loop apparatus.

11. The method as set forth in claim 10 including the step of detaching at least one of the tabs from one or another of the one end and the other end or from the strap to release the at least one element from within the strap.

* * * * *